US005616005A

United States Patent [19]

Whitehead

[11] Patent Number: 5,616,005

[45] Date of Patent: Apr. 1, 1997

[54] FLUID DRIVEN RECIPRICATING APPARATUS

[75] Inventor: John C. Whitehead, Davis, Calif.

[73] Assignee: Regents of the University of California, Oakland, Calif.

[21] Appl. No.: 335,605

[22] Filed: Nov. 8, 1994

[51] Int. Cl.[6] ..... F04B 49/00; F04B 17/00

[52] U.S. Cl. ..... 417/46; 417/346; 417/342; 417/393; 417/397; 417/401; 91/295

[58] Field of Search ..... 417/46, 47, 344, 417/392, 393, 283, 284, 285, 395, 426, 346, 342, 347, 397, 401; 91/295, 300, 301, 319, 323

[56] References Cited

U.S. PATENT DOCUMENTS

| | | | |
|---|---|---|---|
| 2,644,401 | 7/1953 | Ragland | 417/344 |
| 2,970,747 | 2/1961 | Kaspar et al. | 417/344 |
| 3,790,310 | 2/1974 | Whelan | 417/393 |
| 3,838,946 | 10/1974 | Schall | 417/395 |
| 4,021,156 | 5/1977 | Fuchs, Jr. et al. | 417/346 |
| 4,334,837 | 6/1982 | Inada et al. | 417/393 |
| 4,381,180 | 4/1983 | Sell | 417/393 |
| 4,386,888 | 6/1983 | Verley | 417/395 |
| 4,490,096 | 12/1984 | Box | 417/342 |
| 4,714,411 | 12/1987 | Searle | 417/347 |
| 4,722,183 | 2/1988 | Rosen | 60/204 |
| 4,830,586 | 5/1989 | Herter et al. | 417/395 |
| 4,854,832 | 8/1989 | Gardner et al. | 417/393 |
| 4,894,986 | 1/1990 | Etheridge | 60/258 |
| 4,936,753 | 6/1990 | Kozumplik et al. | 417/238 |
| 5,026,259 | 6/1991 | Whitehead et al. | 417/379 |
| 5,222,873 | 6/1993 | Whitehead et al. | 417/344 |
| 5,232,352 | 8/1993 | Robinson | 417/393 |
| 5,277,555 | 1/1994 | Robinson | 417/393 |
| 5,427,507 | 6/1995 | Whitehead | 417/344 |
| 5,441,281 | 8/1995 | Baland | 417/393 |

FOREIGN PATENT DOCUMENTS

| | | | |
|---|---|---|---|
| 093018305 | 9/1993 | Australia | 417/395 |
| 2102509 | 2/1983 | United Kingdom | 417/393 |
| 2120733 | 12/1983 | United Kingdom | 417/393 |

OTHER PUBLICATIONS

AIAA 93–2121, Bipropellant Propulsion With Reciprocating Pumps, J.C. Whitehead, Jun. 28–30, 1993.

*Primary Examiner*—Timothy Thorpe
*Assistant Examiner*—Xuan M. Thai
*Attorney, Agent, or Firm*—L. E. Carnahan; Henry P. Sartorio

[57] ABSTRACT

An apparatus comprising a pair of fluid driven pump assemblies in a back-to-back configuration to yield a bi-directional pump. Each of the pump assemblies includes a piston or diaphragm which divides a chamber therein to define a power section and a pumping section. An intake-exhaust valve is connected to each of the power sections of the pump chambers, and function to direct fluid, such as compressed air, into the power section and exhaust fluid therefrom. At least one of the pistons or diaphragms is connected by a rod assembly which is constructed to define a signal valve, whereby the intake-exhaust valve of one pump assembly is controlled by the position or location of the piston or diaphragm in the other pump assembly through the operation of the rod assembly signal valve. Each of the pumping sections of the pump assemblies are provided with intake and exhaust valves to enable filling of the pumping section with fluid and discharging fluid therefrom when a desired pressure has been reached.

33 Claims, 12 Drawing Sheets

FLUID DRIVEN RECIPRICATING APPARATUS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to reciprocating pumping apparatus, particularly to a pair of fluid driven reciprocating pumps, and more particularly to a pair of fluid driven reciprocating pumps having at least one power chamber controlling a signal valve assembly and each having an intake-exhaust valve.

Fluid driven reciprocating pump assemblies have been utilized for a variety of applications for pumping various types of fluids, such as fuel, liquid propellant, hydraulic fluid, and many other fluids in industrial processes, with the pump assemblies being powered by a source of compressed air, combustion products, etc. The reciprocating pump assemblies have included pumps of the free-piston and diaphragm types which function to divide the pump chambers into power and pumping sections. Alternatively, a free surface resulting from gravity has been used to separate liquid being pumped from a driving gas. Various valve arrangements have been developed, especially where the reciprocating pump assemblies operate in pairs or sets to control the driving fluid to the power sections thereof. These prior reciprocating pumping systems and control valve assemblies are exemplified by U.S. Pat. No. 4,021,156 issued May 3, 1977 to F. J. Fuchs, Jr. et al.; U.S. Pat. No. 4,854,832 issued Aug. 8, 1989 to R. K. Gardner et al.; U.S. Pat. No. 4,936,753 issued Jun. 26, 1990 to N. Kozumplik, Jr., et al.; U.S. Pat. No. 5,026,259 issued Jun. 25, 1991 to J. C. Whitehead et al.; and U.S. Pat. No. 5,222,873 issued Jun. 29, 1993 to J. C. Whitehead et al. More recently a less complex valving arrangement has been developed for pairs of fluid driven reciprocating pumps, either of the free piston or diaphragm types, which utilizes a signal valve attached to each pump assembly to control the intake-exhaust valve of the other pump assembly, and is described and claimed in copending U.S. application Ser. No. 08/081,695, filed Jun. 25, 1993, entitled "Valving For Controlling A Fluid-Driven Reciprocating Apparatus now U.S. Pat. No. 5,427,507 issued Jun. 27, 1995".

Fluid-driven reciprocating pumps of various types have been utilized extensively in industry, where compressed air and other pressurized fluids are widely used as power sources, rather than electricity. Water pumps which are used in a wet environment and driven by compressed air, for example, eliminate the electric shock hazard involved in using electric motors or electric-driven tools in wet environments. Also, pumps driven by compressed air simply stop when a downstream valve is shut, and power from the power source ceases to flow (no air flow is wasted). For electric pumps, current continues to flow when they stop for some reason other than shutdown, so that energy is wasted, and the electric motor may overheat. In an industrial plant setting, compressed air is available "on tap", and cost is often less when an air-driven mechanism is used instead of an electric-driven mechanism. Finally, pumps driven by a fluid such as compressed air can operate over a wide range in flow rate with a minimal change in operating pressure.

For the above reasons, air-driven pumps are widely used, and are produced by numerous companies. They typically have two air power chambers which are alternately pressurized to stroke the pump back and forth.

Many of the fluid driven pumps utilize a diaphragm in each chamber of the pump to separate the power and pumping chambers formed on the opposite side of the diaphragm. Diaphragm pumps historically have used a mechanical trip or a single-stage valve to control the reciprocating motion of the diaphragms. Mechanical trips need to be replaced often because the detent device and/or the springs lose their recoil tension.

Diaphragm pumps equipped with a single-stage valve are susceptible to stalling. When one of these pumps is operated at slow cycle speeds, or used to pump heavy material, the over-travel of the diaphragm is reduced and so is the duration of the shift signal. This condition may cause the valve to only partially shift or stop completely. Either of these conditions will keep the pump from running. In order to operate at any speed without spring-latch mechanisms or mechanical trips (which wear out) or complicated rotating parts, reciprocating machines driven by fluid require at least three moving parts to oscillate automatically, without stalling. This principle has been exploited by the more recent prior art. The standard class of mechanism in use is one in which the three parts are: 1) the main double-acting pump element (connected pistons or diaphragms), 2) an intake-exhaust valve which controls the flow into and out of both power chambers, and 3) a pilot valve. Near the end of a stroke, the main pump element contacts the pilot valve and moves it slightly, which pneumatically changes the state of the intake-exhaust valve. In these prior art mechanisms, the three moving parts are individually different so they are manufactured as distinct, separate items. In at least one commercially available pump, sold by The ARO Corp. as the ARO ½ inch Diaphragm Pump, and described in above-referenced U.S. Pat. No. 4,854,832, the pilot valve is off-center so that the entire assembly is unsymmetrical and therefore relatively complicated.

The above-referenced U.S. Pat. No. 4,854,832 uses a two-stage valve to control the reciprocating motion of the pump. A pilot valve supplies a pilot signal to the power valve throughout the entire stroke or cycle of the pump. The pilot valve of this pump system illustrated in FIGS. 1 and 2, is not connected to the diaphragm connecting rod or the diaphragms. The pilot valve is oriented between the air chambers so that mechanical force moves the pilot valve to signal position, which in turn shifts the power valve.

The air from the power valve of this prior pump system (see FIGS. 1 and 2) continues to shift the pilot valve and hold it in position, even after the mechanical force is removed. This action positions the pilot valve for the next cycle and maintains the pilot signal throughout the entire cycle of the pump. This non-symmetrical pilot valve design allows the pump to run a slow cycle speed and with heavy materials without the pump stalling and stopping the flow of production materials. However, this pilot valving arrangement is complicated and thus costly to manufacture, and the intake or exhaust fluid must flow through long narrow passageways within the valve assembly. In particular, the power valve of above-referenced U.S. Pat. No. 4,854,832 is a complicated four-way valve because it must provide for intake and exhaust of both power chambers. As a result, the intake and exhaust flow passageways are small and restrictive relative to the size of the power valve. One consequence of restrictive passageways for the exhaust flow is cooling and the formation of ice in the valve. Another difficulty with the complicated four-way power valve is that sliding surfaces and reciprocating seals are required, which results in wear. An additional drawback is that the operational states of both power chambers switch simultaneously, so that positive pressurization overlap of the two power chambers is impossible.

There is a need in the art for a simplified valving arrangement for fluid driven pumps. This need has been satisfied by the present invention which utilizes in one embodiment a fluid driven apparatus having back-toback power chambers. A signal valve assembly is connected to at least one of the pistons or diaphragms in the power chambers for controlling a pair of intake-exhaust valves, each connected to one of the power chambers and to a source of pressurized fluid. Thus, activation of one of the power chambers is controlled by the state of pressurization in the opposite chamber, with switch over accomplished by the signal valve at the end of each stroke. As a result of having a separate intake-exhaust valve for each power chamber, flow passageways are larger, valve seats can be used instead of reciprocating seals or sliding surfaces, positive pressurization overlap of the two power chambers becomes possible, and the pilot valve function can be incorporated into the rod which connects the two diaphragms.

Accordingly, the invention involves a pair of fluid driven pumps, similar to those disclosed in above-referenced U.S. Pat. No. 5,222,873, and utilizing an intake-exhaust/signal valve arrangement which operate on principles similar to that of above-referenced application Ser. No. 08/081,695 now U.S. Pat. No. 5,427,507. The present invention provides a fluid driven pump system which in one embodiment uses a back-to-back configuration to yield a bi-directional pump, and is simpler in construction than existing commercial systems. The present invention also eliminates a particular stall condition of the valves disclosed in above-referenced U.S. Pat. No. 5,222,873, for example.

SUMMARY OF THE INVENTION

An object of the present invention is to provide a fluid driven pump system having intake-exhaust valves controlled by the state of fluid displacement in the power chamber of the pump assemblies.

A further object of the invention is to provide a fluid driven pump assembly having at least one power chamber and a pair of intake and exhaust valves control by a single signal valve.

A further object of the invention is to provide a fluid driven pump system having the capability of providing for back-to-back power chambers, large intake-exhaust flow passageways, valves which can use seats instead of sliding seals, and pressurization overlap of the two power chambers.

A further object of the invention is to provide a pair of pump assemblies, wherein driving fluid for each pump is controlled by one or both pumps.

A further object of the invention is to provide a fluid-driven reciprocating apparatus which has separate power chambers, and a valving arrangement which eliminates the possibility of stalling.

A still further object of the invention is to provide a fluid driven reciprocating apparatus having back-to-back power chambers with signal rods connected so as to control a pair of intake-exhaust valves for supplying driving fluid to the power chambers.

Another object of the invention is to provide a fluid driven back-to-back pump system with a valving arrangement which is simpler than prior known valving arrangements, while providing large flow passages for a given valve size.

Another object of the invention is to provide a fluid driven pump system having a pair of pump assemblies each having an intake-exhaust valve, and a signal valve connected to a movable member in only one of the pump assemblies.

Another object of the invention is to provide a particular valving configuration in which a single signal rod connected to at least one of the movable members in a pair of fluid pumps, activates or inactivates an intake-exhaust valve for each of fluid pumps.

Another object of the invention is to provide a pair of back-to-back pump assemblies with an interconnecting sleeve/valve arrangement for controlling driving fluid to the pump assemblies, so that the connecting rod can be shorter to provide a more compact pump.

Other objects and advantages will become apparent from the following description and accompanying drawings. The fluid driven pump system of this invention, like the prior systems described above, has a minimum of three moving parts to oscillate automatically. However, two of the moving parts, the intake-exhaust valves, are identical, which can reduce manufacturing costs, and they are of a simple construction. The prior known pilot valve, such as disclosed in above-referenced U.S. Pat. No. 4,854,832, is eliminated, and its function is provided by enlargements on a rod which is connected to a movable member in at least one pump assembly. In addition the pumping system of this invention reduces or eliminates nonsymmetrical or off-center moving parts, and the port in each power cylinder is directly connected to its own intake-exhaust valve, instead of fluid connections being through long passageways to a single centrally located valve. Thus, flow losses can be reduced by integrating each intake-exhaust valve closely with its power chamber.

The present invention has application in any compressed air or pressurized fluid systems, including many systems using a back-to-back pumping arrangement. Thus, this invention provides a significant advance in the field of fluid driven reciprocating apparatus.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

The invention is directed to a fluid driven reciprocating apparatus comprising a pair of pump assemblies, with one embodiment having back-to-back power chambers with a common signal rod which activates an intake-exhaust valve for each of the pump assemblies. Another embodiment utilizes a signal rod connected to only one pump assembly. The valving arrangement is simplified in both construction and operation, with the port in each power chamber being connected directly to its own intake-exhaust valve. The reciprocating apparatus of this invention utilizes a signal (pilot) valve arrangement having a rod connected to at least one of the two movable members (pistons or diaphragms) in the pump chamber, whereby the intake-exhaust valve of one pump is activated by the location of the rod and the state of pressurization in the other pump. In one embodiment, the rod of the signal valve is connected to only one movable member, and the power chambers need not be in a back-to-back arrangement. In other embodiments, the signal or pilot valve uses a sleeve positioned around the connecting rod of the movable members, or signal valving may be activated by float switches.

Figure 2:
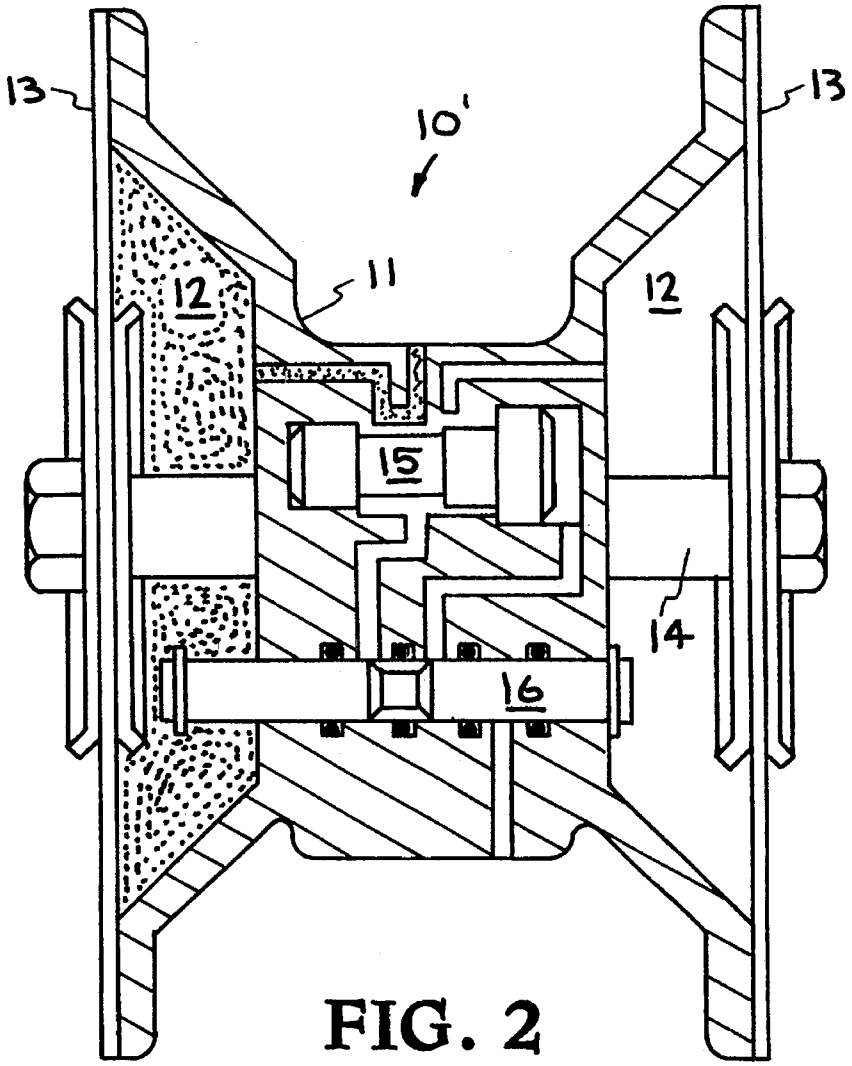
FIGS. 1 and 2 illustrate in partial cross-section a prior art compressed air driven dual pumping system.
Figure 1:
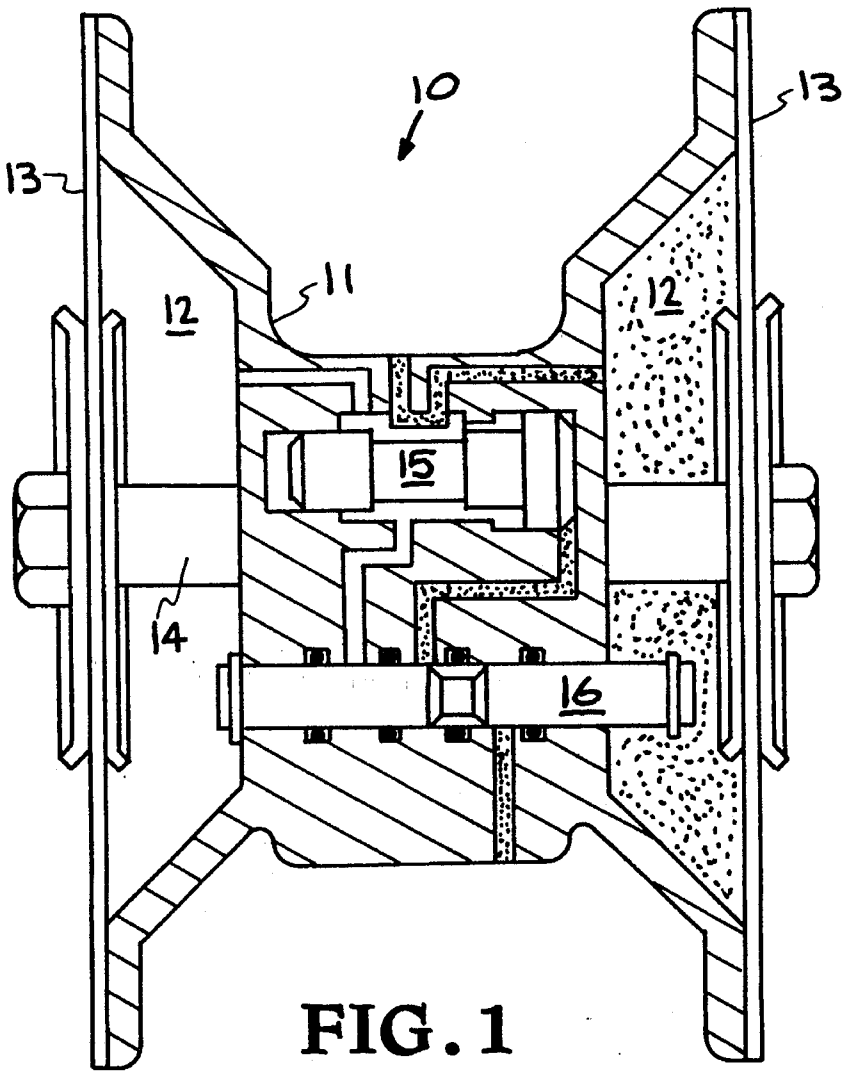

FIGS. 1 and 2 illustrate a prior art diaphragm pump assembly, similar to that of above referenced U.S. Pat. No. 4,854,832, which uses a two-stage valve to control the reciprocating motion of the pump. The pump assembly generally indicated at 10 comprises a housing 11 defining a pair of power chambers 12 in which a pair of diaphragms 13 are mounted and interconnected by a shaft or rod 14. A power (intake-exhaust) valve 15 (a four-way valve) and a pilot (signal) valve 16 (a three-way valve) are mounted in the housing 11. Fluid passageways in the housing interconnect the power valve 15 with each of the power chambers 12, a fluid pressure supply, not shown, pilot valve 16, and fluid exhausts. The pilot valve 16 supplies a pilot signal to the power valve throughout the entire stroke or cycle of the pump assembly. The pilot valve 16 is free floating (not connected to the diaphragms 13 or to the connecting shaft 14). The pilot valve 16 is oriented between the power chambers 12 so that mechanical force moves the pilot valve to the signal position, which in turn shifts the power valve 15. The fluid from the power valve 15 continues to shift the pilot valve 16 and hold it in position, even after the mechanical force is removed, and thus positions the pilot valve for the next cycle and maintains the pilot signal throughout the entire cycle of the pump.

The valving arrangement of the present invention utilizes a pair of intake-exhaust valves and a signal (pilot) valve which includes enlargements on the shaft or rod which interconnects the diaphragms (pistons) and functions to control the two intake-exhaust valves which are located adjacent ports in the power chambers of the pump assembly. Thus, by comparison between FIGS. 1–2 and FIGS. 3–6 it is readily seen that the present invention provides a dual pump assembly with a valving arrangement that eliminates the pilot valve and incorporates its function into the connecting rod. Also eliminated or simplified is the complex four-way valve, and the extensive interconnecting fluid passageways of the prior art pumping system illustrated in FIGS. 1 and 2.

Referring now to FIGS. 3–6 which illustrate an embodiment of the present invention, the fluid driven reciprocating apparatus basically comprises a pair of back-to-back pump assemblies generally indicated at 20 and 21, a pair of intake-exhaust valves generally indicated at 22 and 23, and a signal valve generally indicated at 24. The pump assemblies 20 and 21 include a housing 25 and 25' having openings or ports 26–26', 27–27' and 28–28'. Inlet and outlet check valves 29–29' and 30–30' are operatively mounted in ports 26–26' and 27–27' which constitute inlet and outlet ports for the fluid to be pumped. A pair of movable members or pistons 31 and 31' are mounted in housing 25 and 25' and define power chambers 32–32' and pumping chambers 33–33' on opposite sides thereof. Note that power chambers 32–32' may be of different diameters than pumping chambers 33–33', in which case pistons 31–31' would be compound, differential area pistons. Housings 25 and 25' are interconnected by a hollow sleeve or member 34 having openings 35, 36, 37 and 38 therein. A rod, shaft or member 39 having enlargements, lands, or heads 40 and 41 thereon interconnect pistons 31–31'. Housings 25 and 25' are also provided with openings or ports 42–42' which are connected by lines or tubes 43–43' to intake-exhaust valves 22 and 23.

Figure 3:
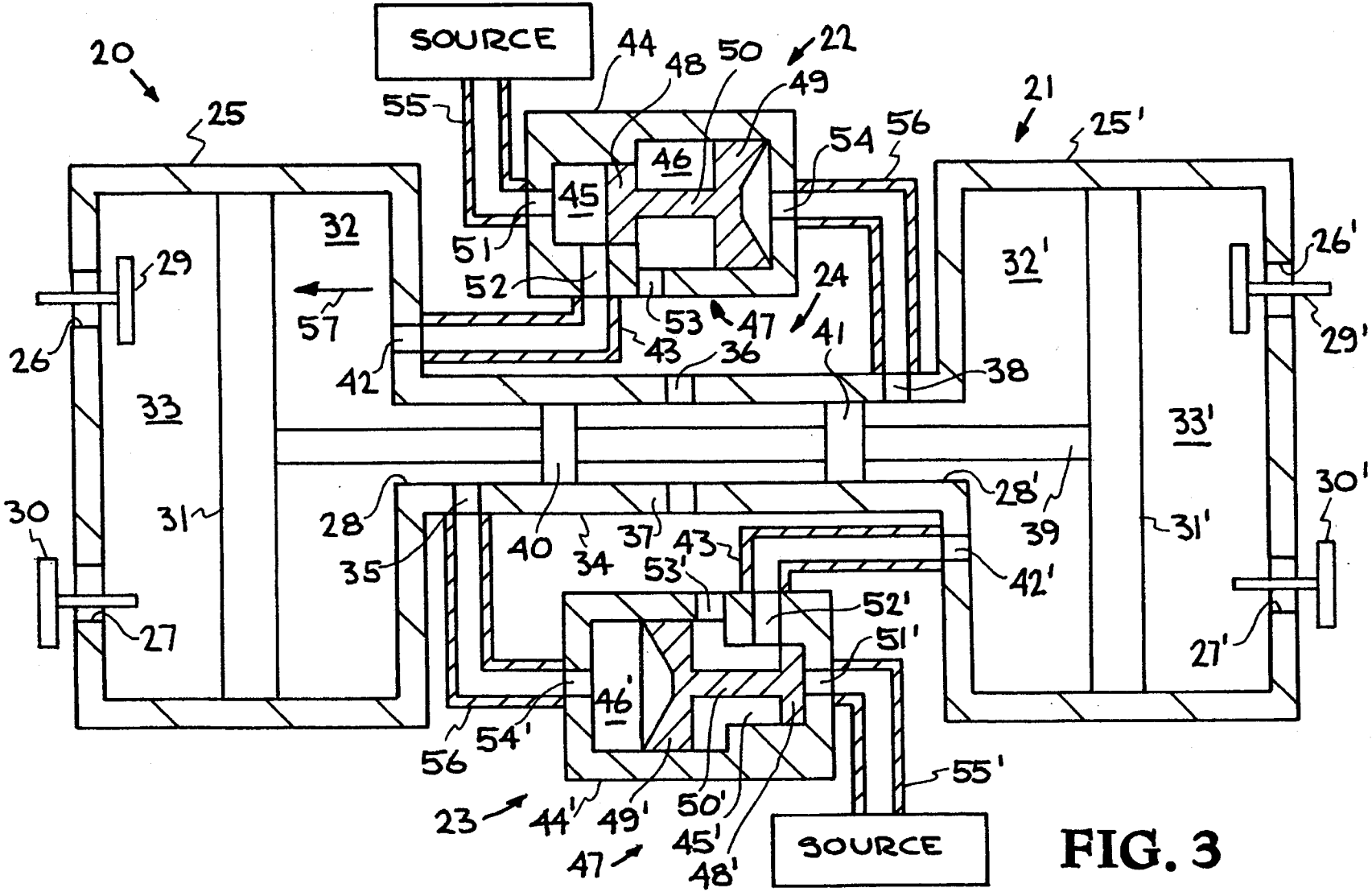
FIGS. 3–6 schematically illustrate an embodiment of a back-to-back fluid driven pumping system and the valving arrangement therefor, as made in accordance with the present invention.

The intake-exhaust valves 22 and 23, are identical in construction, but connected in opposite directions, as seen in FIGS. 3–6. The valves 22 and 23 each have a housing 44–44' defining a pair of different diameter chambers 45–45' and 46–46' in which valve members generally indicated at 47–47' are positioned. Valve members 47–47' are each composed of a pair of different diameter enlargements or heads 48–48' and 49–49' interconnected by a rod or shaft 50–50', with the heads 48–48' being located in chambers 45–45' and heads 49–49' being located in chambers 46–46'. Each of valve housings 44–44' are provided with openings or supply ports 51–51', 52–52', 53–53' and 54–54'. Ports 51–51' are supply ports connected by lines or tubes 55–55' to a source of fluid pressure, such as compressed air, as indicated by legends. Ports 52–52' are connected to lines 43–43' which are connected to ports or openings 42–42' in pump housings 25–25'. Ports 53–53' are exhaust ports, but may be connected to a collection chamber if desired. Ports 54–54' are connected by lines or tubes 56–56' to openings 38 and 35, respectively, in the hollow shaft FIGS. 3–6 illustrate various operating stages of the back-to-back pump assembly of this invention. As shown in FIG. 3, valve 22 is positioned such that pressure fluid, such as compressed air, is directed through line 55, valve chamber 45, line 43 into power chamber 32 of pump 20 to move piston 31 outwardly as indicated by arrow 57; while valve 23 is positioned such that fluid from power chamber 32' of pump 21 is exhausting through line 43', valve chamber 45' and exhaust port 53'; with the enlargements or heads 40 and 41 of signal valve 24 being located intermediate openings or ports 35 and 38, with openings 36 and 37 functioning as vent ports. Note that, as shown in FIG. 3, when fluid pressure is being supplied to power chamber 32 it is also directed into chamber 46' of valve 23 via member 34, opening 35, line 56' and port 54', while chamber 46 of valve 22 is open to vent on one side of valve head 49 via port 53 and open to exhaust on the opposite side of head 49 via port 54, line 56, opening 38, member 34 to power chamber 32', which is exhausted via line 43' and exhaust port 53', As shown in FIG. 3, the valve 22 is in "intake open" position and valve 23 is in "exhaust open" position.

Figure 4:
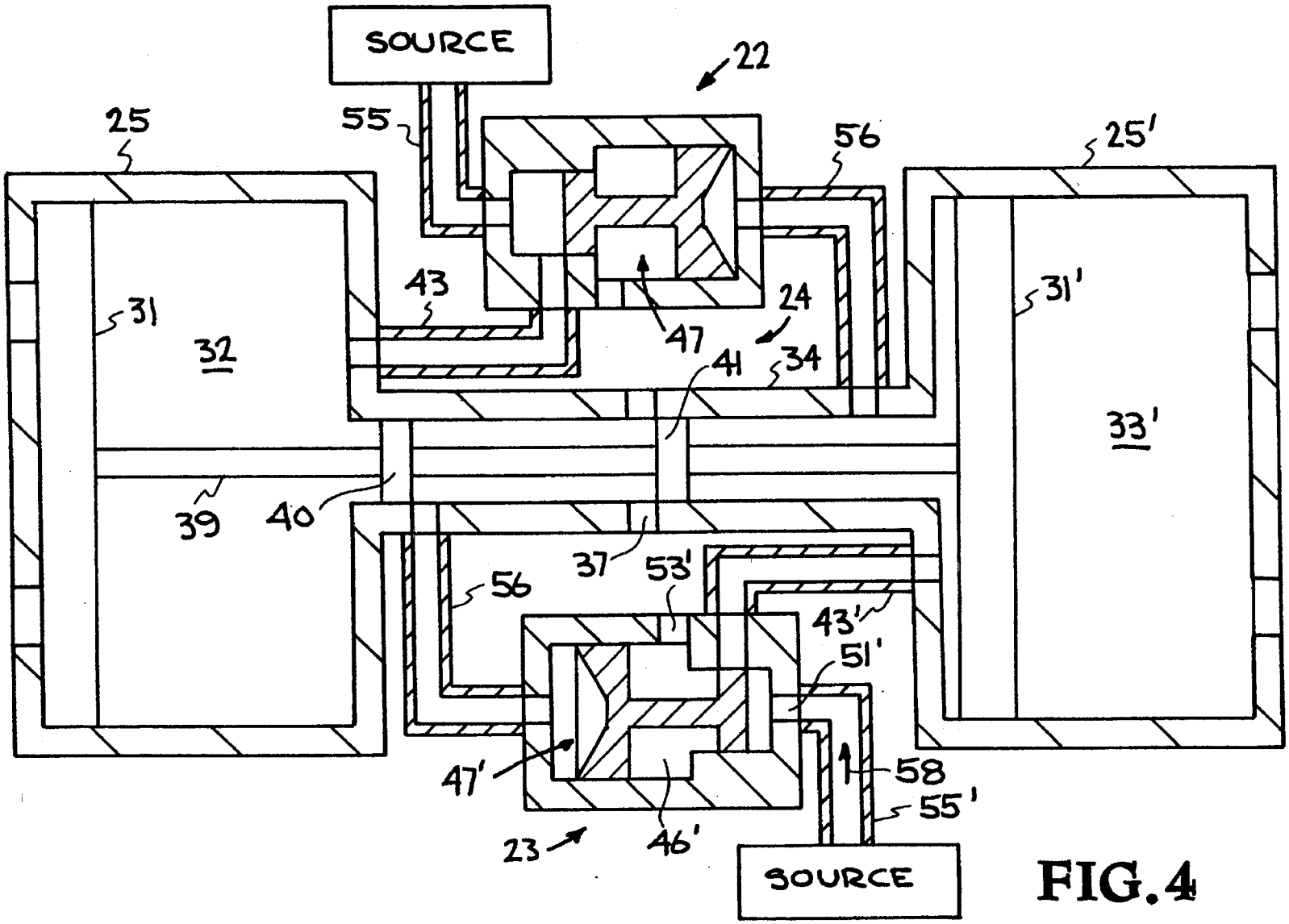

Continued movement of piston 31 in the direction of arrow 57 drives the piston to the end of its stroke, as shown in FIG. 4. Note that the piston 31' is in a spaced location with respect to port 42'. At this point the heads 40 and 41 on rod 39 of signal valve 24 have moved to such that head 40 blocks flow of pressurized fluid to valve 23 and opens valve 23 to vent via port 54', line 56', opening 35, member 34 to vent ports 36 and 37, which allows valve member 47' to move to the left as shown. As shown in FIG. 4, the valve 22 remains in the "intake open" position and valve 23 is in a "switching" position.

As the chamber 46' in valve 23 continues to vent, member 47' which has pressured fluid applied thereto via line 55' and port 51', as shown by the arrow 58 in FIG. 4, moves to the left as shown until valve member head 48' uncovers port 52'. This allows the pressurized fluid to flow through valve chamber 45' and line 43' into power chamber 32' of pump 21 as shown by the arrow 59 in FIG. 5, and as indicated, the valve 23 is in the "intake open" position and the valve 22 is in the "switching" position.

Figure 5:
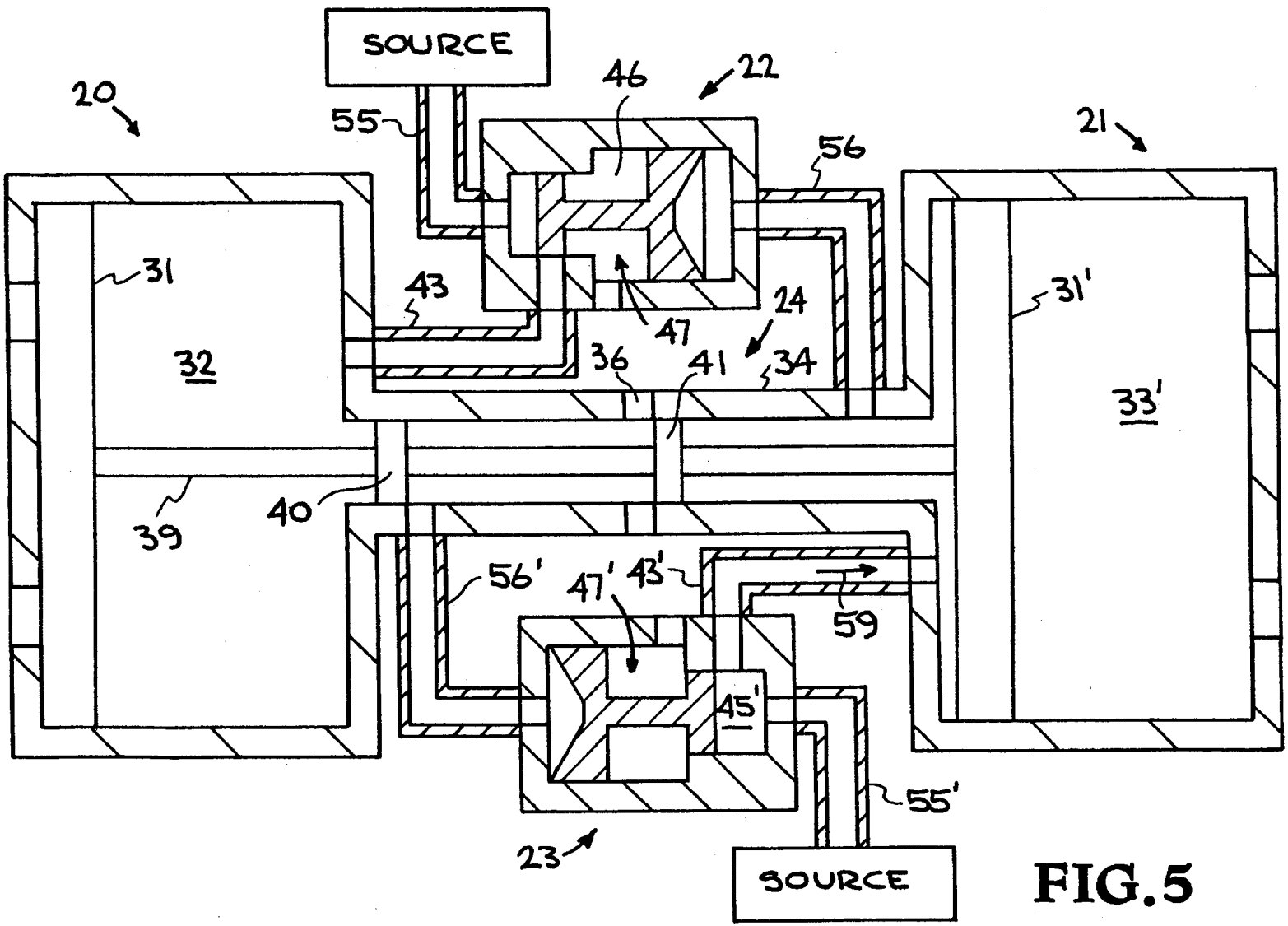

As seen in FIG. 5, pressurized fluid indicated by arrow 59 directed into power chamber 32' of pump 21 is also directed into chamber 46 of valve 22 via member 34 and line 56 such that valve member 47 is moved to the left as shown whereby head 48 blocks passage of pressurized fluid to power chamber 32 of pump 20. Note that during switchover at the end of a stroke, there is a brief time when both power chambers 32–32' are simultaneously pressurized.

Figure 6:
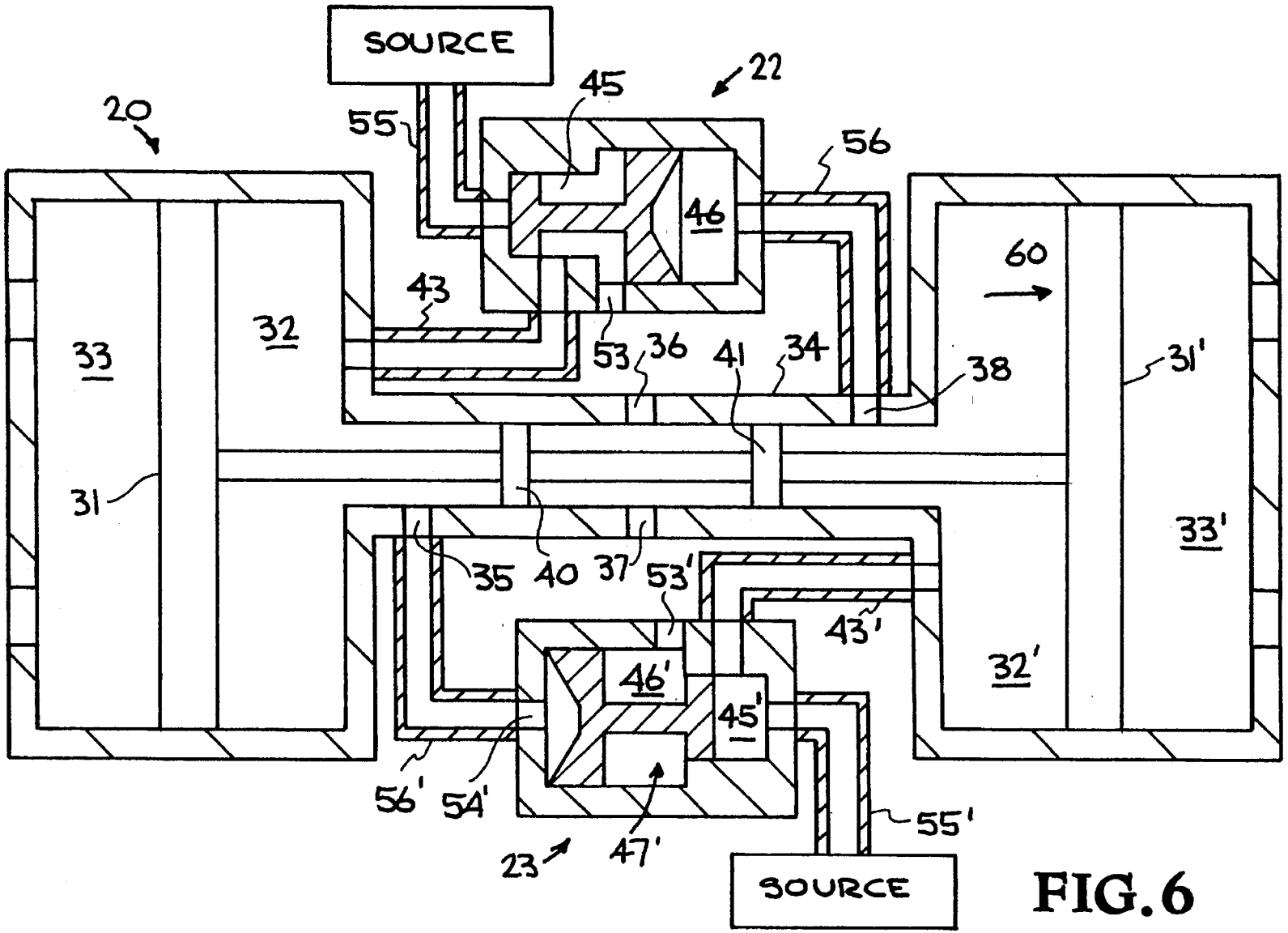
Figure 7:
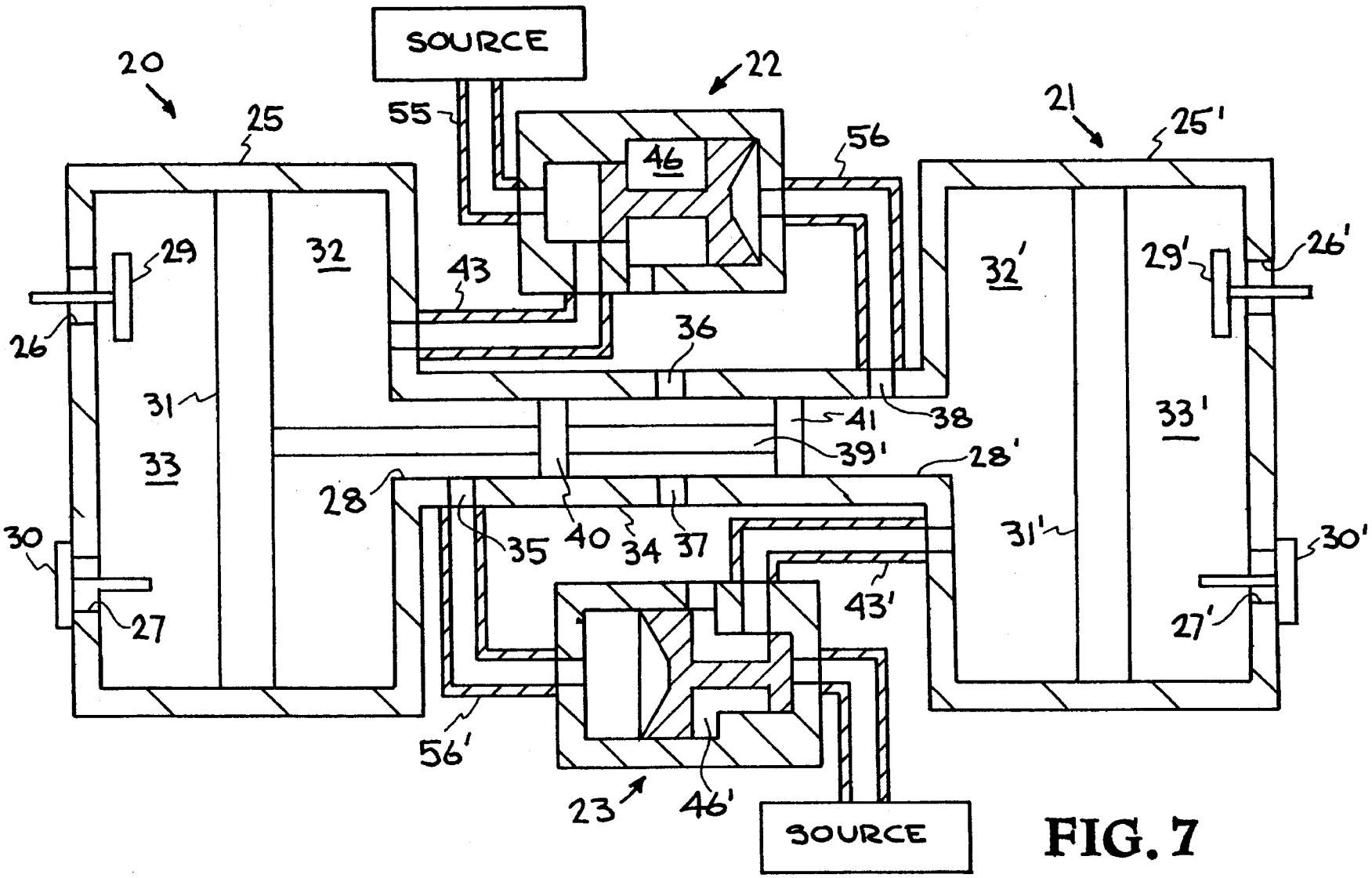
FIGS. 7–10 illustrate an embodiment similar to that of FIGS. 3–6, but with the signal rod connected to only one movable member of the pair of pump assemblies.
Figure 8:
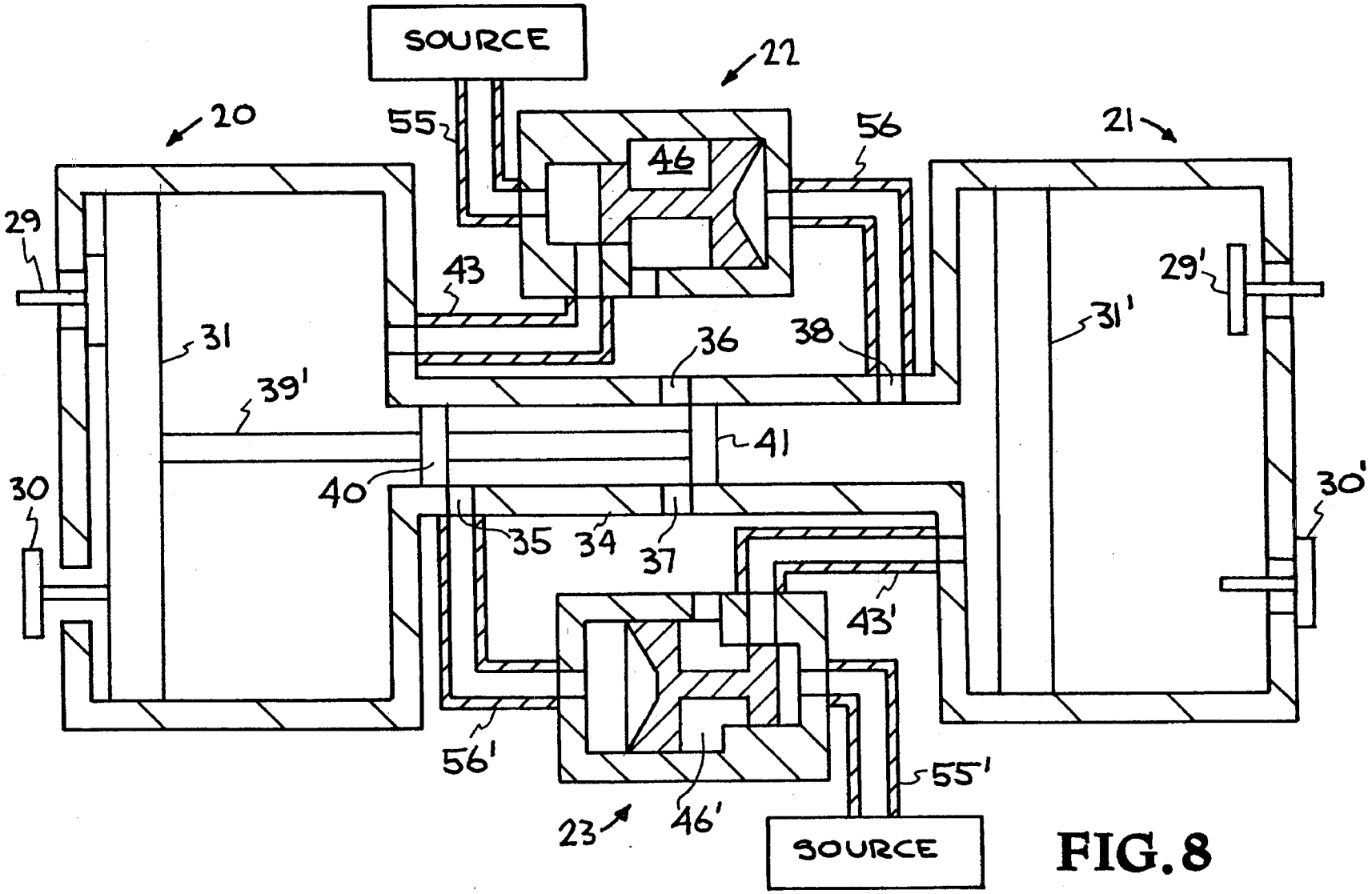
Figure 9:
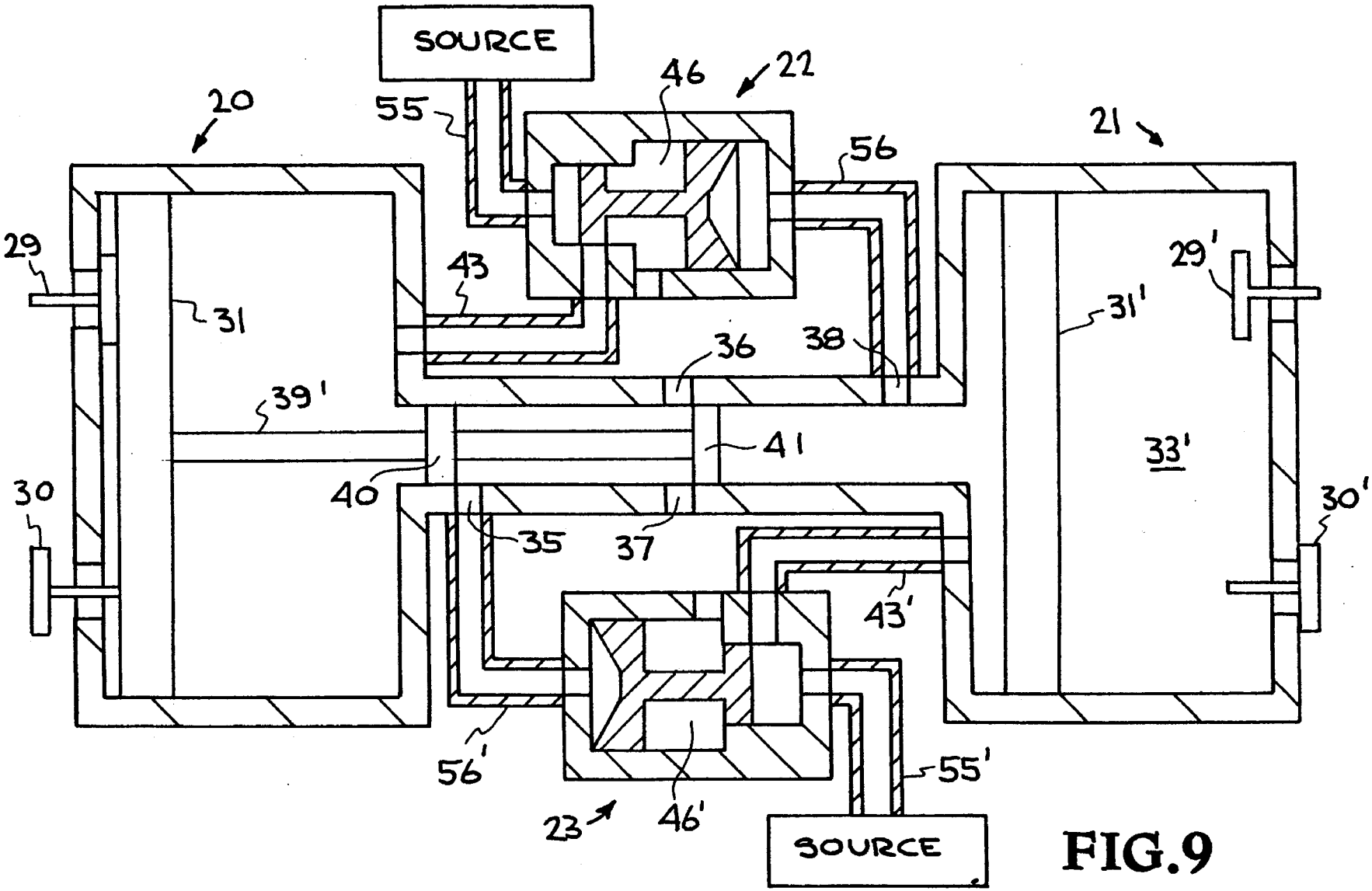
Figure 10:
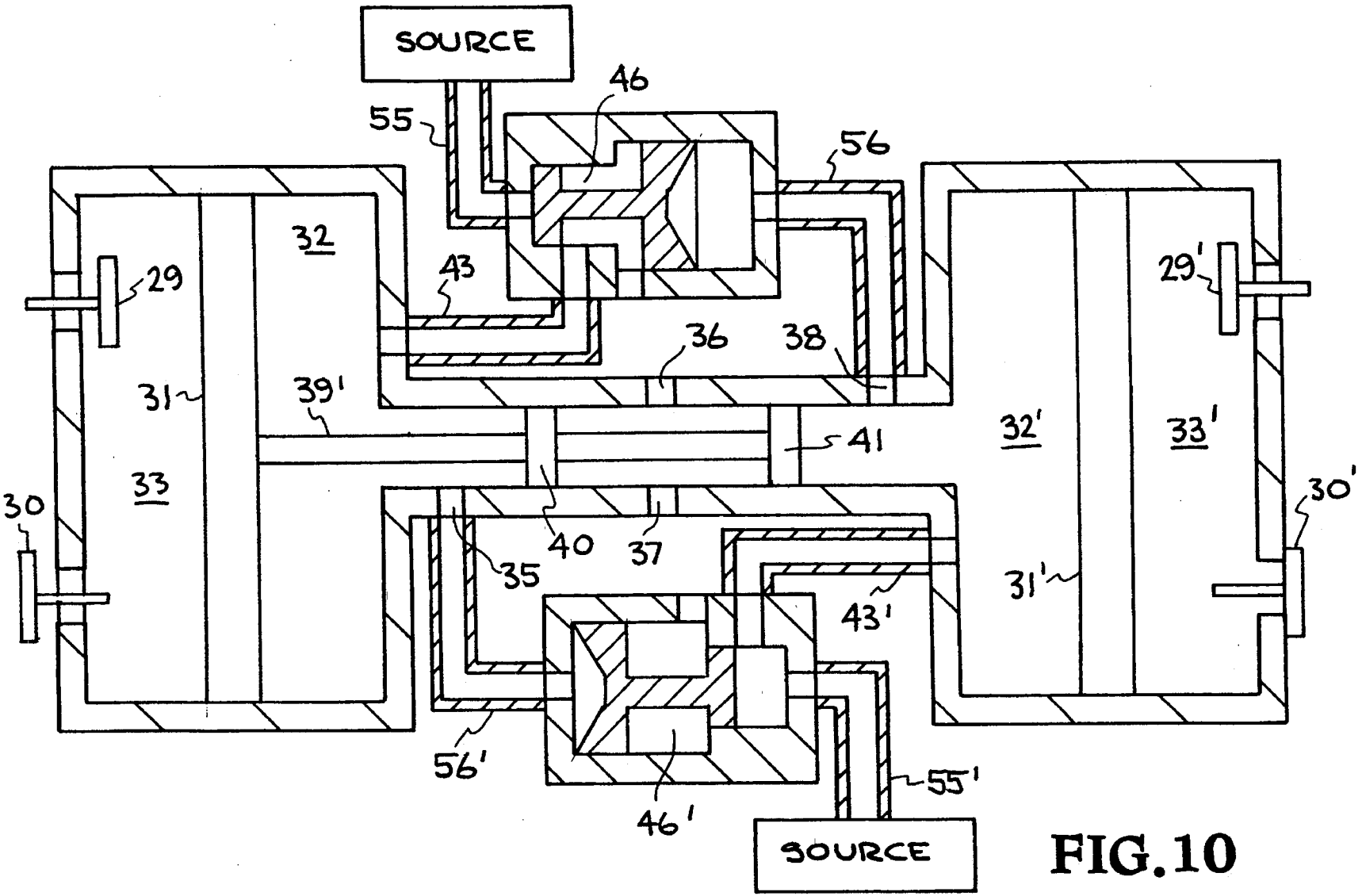

As pressurized fluid continues to flow into power chamber 32' and valve 22 it forces the valve member 47 further to the left as shown whereby head 48 uncovers port 52 and power chamber 32 is open to exhaust via line 43; port 52, valve chamber 45 and exhaust port 53, as seen in FIG. 6. Continued flow of pressurized fluid into power chamber 32' moves piston 31' to the right as shown and indicated by arrow 60 in FIG. 6. Movement of piston 31 as shown in FIG. 6, causes rod 39 of signal valve 24 to move to the right as shown, whereby head 40 is moved to the right allowing valve chamber 46' to vent through power chamber 32 of pump 20 instead of through vent ports 36 and 37 as in FIG. 5. As seen by the legends in FIG. 6, the valve 22 is in the "exhaust open" condition and the valve 23 is in the "intake open" condition.

As the piston 31' is moved to the right to the end of its stroke, signal valve 24 causes a switch of the operation of intake-exhaust valves 22 and 23 to the positions illustrated in FIG. 3 where valve 22 is in an "intake open" condition and valve 23 is in an "exhaust open" condition, whereby power chamber 32 of pump 20 is pressurized and power chamber 32' of pump 21 is exhausted, and the cycle is repeated as described above and illustrated in FIGS. 3–6.

While the pumps 20 and 21 of the FIGS. 3–6 embodiment illustrates a piston as the movable member in each pump, the pistons can be replaced with flexible diaphragms having the edges or peripheries connected and sealed to the housing to define a power chamber and a pumping chamber in each pump. Also, while not shown, the pistons 31–31', valve members 47–47' of valves 22 and 23, and enlargements or heads 40 and 41 of valve 24, are provided with appropriate sealing means, such as o-rings, to prevent fluid leakage thereby. In addition, the various ports in the valves 22 and 23 may be provided with appropriate valve seats which cooperate with the various heads to produce the desired fluid flow thereto as well as to cooperate with the sealing means of the valve member heads to reduce leakage to negligible levels. The seals and valve seats may be of the type illustrated in AIAA 93-2121, "Bipropellant Propulsion with Reciprocating Pumps", J. C. Whitehead, June 1993, wherein a soft intake seat should be used to accommodate dimensional variability to ensure that both the intake seat and pilot seat always make contact and seal simultaneously. Also, for certain applications, the inlet and outlet check valves in the pumping chambers may be omitted or the outer end of the pump housing removed such that movement of the pistons drive a fluid which in turn drive a mechanism, or the pistons are connected to a mechanism for driving same.

FIGS. 7–10 illustrate an embodiment of a back-to-back fluid driven pump assembly, generally similar to the FIGS. 3–6 embodiment, except that the rod of the signal valve is only connected to one of the pair of pistons, in order to permit positive overlap of the delivery strokes of the two pumping chambers. This embodiment differs from that of FIGS. 3–6 in that there must be a positive pressure in the pumping chambers (33–33') to ensure a return stroke, and there must be inlet and outlet check valves (29–30 and 29'–30') for the pumping chamber of each pump assembly.

The components of the FIGS. 7–10 embodiment are identical to those of the FIGS. 3–6 embodiment, except for the control rod 39 not being connected to piston 31' of pump assembly 21. Thus, corresponding components will be given corresponding reference numerals, with the control rod in FIGS. 7–10 being indicated by reference numeral 39'. A comparison of the location of the valve components of valves 22, 23, and 24 in each of FIGS. 7–10 with the same valve components in FIGS. 3–6 will show the operation thereof to be substantially identical. However, the pump 21 of the FIGS. 7–10 embodiment need not be in a back-to-back relation with pump 20 as shown, and in fact can be located separate from pump 20, with fluid supply line 43' interconnecting valve 23 with chamber 32' of pump 21, and with the right end as shown of the housing 34 of signal valve 24 being connected adjacent (to the right of as shown) port or opening 38, via a tube (not shown) to power chamber 32'. As is evident from FIG. 9, positive overlap of the delivery strokes of the two pistons is made possible by the freedom of piston 31' to move independently from rod 39'. In the FIGS. 7–10 embodiment, there must be a positive source pressure present in chambers 33–33' to assure the return stroke of pistons 31–31'. This positive pressure may be supplied, for example, by an accumulator or low pressure source, or by back pressure from the fluid pressure directed against a mechanism, such as a piston for moving a rod, or a spring, etc. As in the FIGS. 3–6 embodiment, the inlet and outlet check valves may be used when a low pressure fluid is to be pumped to increase the pressure thereof or to be directed to a point of use. However, in applications where the pumped fluid is to be used to drive a mechanism, etc. the inlet and outlet check valves can be omitted. From the foregoing description of FIGS. 7—10, it can be appreciated that the present invention provides for positive overlap of two separate pumps, while eliminating the stall condition inherent to the two separate pumps of U.S. Pat. No. 5,222,873, for example. This is accomplished by actuating both signal valves from one pump instead of having one signal valve on each pump.

Figure 11:
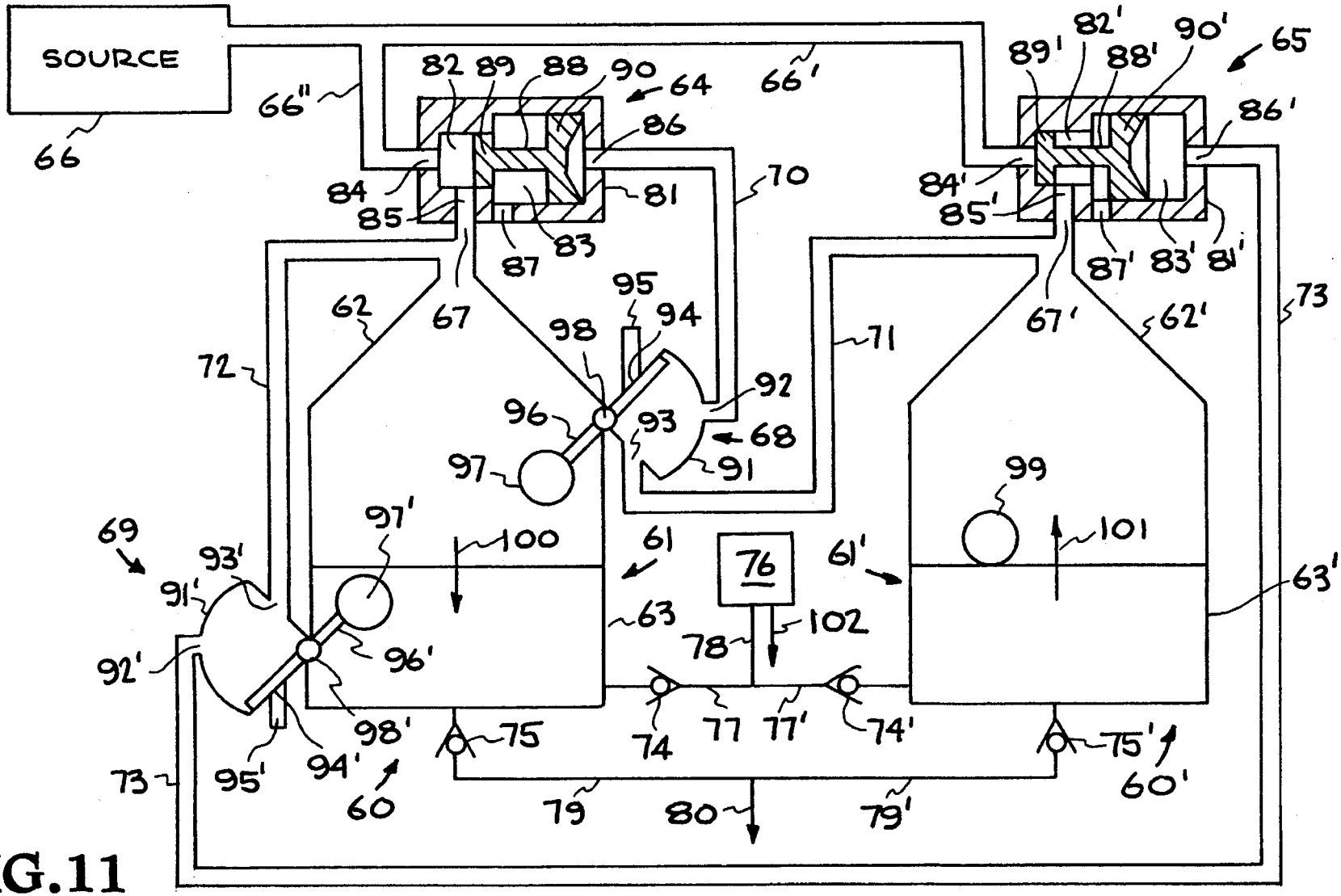
FIG. 11 illustrates another embodiment of the invention for alternately pressurizing and exhausting a pair of chambers.

As seen in the FIG. 11 embodiment, the pistons 31–31' of FIGS. 3–10 can be eliminated. In this embodiment, the driving fluid or gas supplied to the power chambers from a pressurized source acts directly on a column of liquid to expel liquid from the pump. For refill, liquid under low pressure forces exhaust of the fluid or gas from the power chambers upon movement of a signal valve which activates an intake/exhaust valve connected to each of the power chambers.

As seen in FIG. 11, this embodiment constitutes an apparatus for alternately pressurizing and exhausting a pair of chambers, and comprises a first pump 60 and a second pump 60' having chambers generally indicated at 61 and 61', each having a power section 62–62' and a pumping section 63–63'. Each of pumps 60 and 60' is provided with an intake-exhaust valve 64 and 65 which are connected to a pressurizing driving fluid source 66 via tubes or lines 66' and 66". Valves 64 and 65 are connected to respective power sections 62 and 62' of pumps 60 and 60' via lines or tubes 67 and 67'. Pump 60 is provided with a pair of signal valves generally indicated at 68 and 69, with Signal valve 68 being mounted in power section 62 of chamber 61, and signal valve 69 being mounted in pumping section 63 of chamber 61. Signal valve 68 is connected to intake-exhaust valve 64 via a line or tube 70 and to line 67' and to power section 62' of pump 60' via a line or tube 71. Signal valve 69 is connected to line 67 and to power section 62 of pump 60 via a line or tube 72 and to intake-exhaust valve 65 via a line or tube 73. Pump 60 and 60' are provided in the pumping sections 63–63' of chambers 61–61' with inlet check valves 74 and 74' and outlet check valves 75 and 75'. Inlet check valves 74 and 74' are connected to a low pressure liquid supply to be pumped, generally indicated at 76 via lines 77–77' and 78 while outlet check valves 75 and 75' are connected via lines 79–79' and line 80 to point of use requiring high pressure pumped liquid as indicated by legend and arrow.

Each of intake-exhaust valves 64 and 65 include a housing 81–81' having therein chambers with two different diameter sections 82–82' and 83– 83'. Valve chamber 82 is in fluid communication via ports 84 and 85 with lines 66" and 67, while valve chamber 82' is in fluid communication via ports 84' and 85' with lines 66' and 67'. Valve chamber 83 is in fluid communication via port 86 with line 70, while valve chamber 83' is in fluid communication via port 86' with line 73. Valve housings 81 and 81' are provided with exhaust ports 87–87'. A valve member 88 and 88' is located in each of valves 64 and 65, having heads 89–89' and 90–90' which are located in valve chamber 82–82' and 83–83'.

Signal valves 68 and 69 include housings 91 and 91', having openings or ports 92–92', 93–93', and 94–94'. Port 92 is connected to line 70 while port 92' is connected to line 73. Port 93 is connected to line 71 and port 93' is connected to line 72. Ports 94 and 94' are vent ports connected to vent lines 95–95'. Each of signal valves 68 and 69 also includes a float lever 96–96' having float sections 97–97' and which swivel about points 98–98' as fluid in power section 62 and liquid in pumping section 63 raises or lowers, as discussed hereinafter. A float 99 is located in chamber 61' of pump 60' and raises or falls with the levels of liquid in pumping section 63' of chamber 61'.

As shown in FIG. 11, driving fluid, such as gas under pressure, from source 66 is directed via lines 66' and 66" valve port 84 valve chamber 82, valve port 85, and line 67 into power section 62 of chamber 61 of pump 60. Also, as shown in FIG. 11, driving fluid is also directed via line 67, line 72, port 93' in housing 91' of signal valve 69, port 92', line 73, port 86' in housing 81' of valve 65, and into chamber 83', which forces valve member 88' to the left, as shown, which blocks fluid flow via line 66' into chamber 82' of valve 65, and vents pump chamber 62'. Also, as shown, valve 65 of pump 60 is open to vent via line 67', valve port 85', chamber 82' and vent port 87', as well as via line 71, housing 91 of signal valve 68, and line 70; and chamber 83 is also open to vent via vent port 87.

As the driving pressure fluid (gas) from source 66 is directed into power section 62 of pump chamber 61, as indicated by arrow 100, liquid in pumping section 63 is forced at high pressure via outlet check valve 75 and line 79 and line 80 to a point of use. As pressure fluid is exhausted from power chamber 62' of pump 60', as indicated by arrow 101, inlet check valve 74' is opened whereby liquid from low pressure source 76 is directed as indicated by the arrow 102 into pumping chamber 63' via line 78, line 77', and inlet check valve 74', and the level of the liquid is indicated by float 99, which also keeps liquid from passing into lines 67' and 71 when chamber 61' is full of liquid.

Signal valves 68 and 69 are switched from the position shown by level (amount) of the fluids (gas and liquid) in chamber 61 of pump 60. Signal valve 69 will vent line 73 to intake-exhaust valve 65 of pump 60' (pivots about point 98' to uncover port 94' and cover port 93') when chamber 61 of pump 60 is full of driving fluid from source 66, and empty of liquid via outlet check valve 75. Signal valve 68 will vent the line 70 to intake-exhaust valve 64 (pivots about point 98 to uncover port 94 and cover port 93) when chamber 61 of pump 60 is empty of driving pressure fluid (full of liquid from low pressure source 76 via intake check valve 74. Switching of the signal valves 69 and 68 provides for the filling or exhausting of driving pressure fluid in chambers 61–61' of pumps 60–60', and thus the filling and exhausting of the liquid to be pumped by pumps 60–60' via intake check valves 74–74' and outlet check valves 75–75'. Thus, liquid may be pumped by a driving pressure fluid without the need for a piston or movable member between the driving fluid and the liquid. In the FIG. 11 embodiment, positive overlap of liquid delivery from the two pumps will occur just as in the embodiment of FIGS. 7–10.

Figure 12:
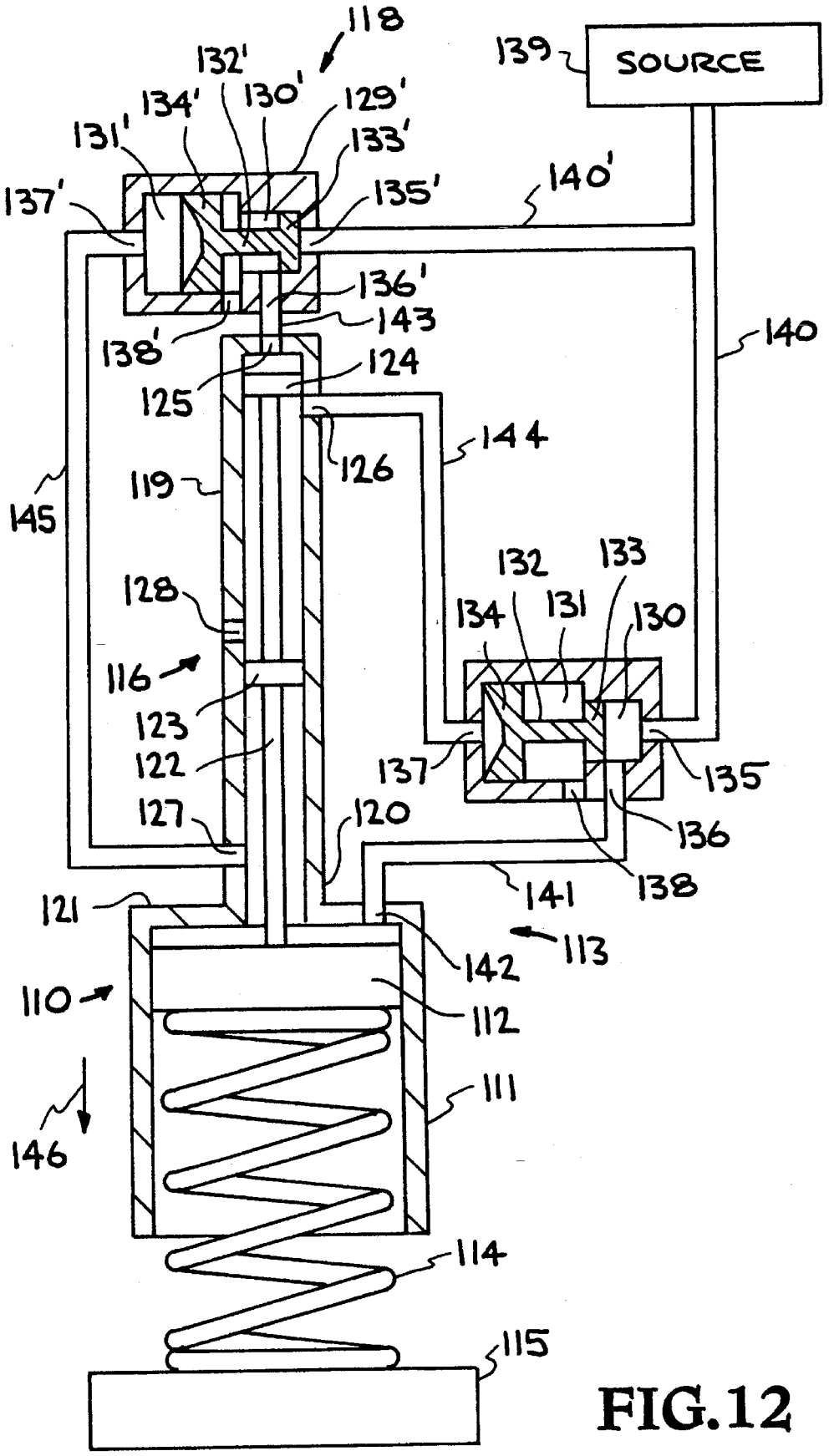
FIG. 12 illustrates a modification of the FIG. 11 embodiment wherein the second chamber is in the form of a fluid line.

FIG. 12 illustrates a further modified embodiment of the FIGS. 7–10 apparatus, which reduces the size of the power pumping chamber and utilizes a spring instead of low pressure fluid to return the piston after completion of its stroke. In the FIG. 12 embodiment, the second pumping chamber consists of a fluid line between the signal valve and one of the two intake/exhaust valves.

The FIG. 12 embodiment comprises a pump, or other fluid power cylinder, generally indicated at 110 having a wall 111 and containing a piston 112 which defines on one side thereof a first chamber 113 and on the opposite side is located a spring 114 which is in abutment with a support 115, which could be replaced by a closed end of wall 111. A signal valve assembly generally indicated at 116, and first and second intake-exhaust valve assemblies generally indicated at 117 and 118 are operatively connected to pump 110.

Signal valve assembly 116 comprises a housing 119 open at one end 120 which is in fluid communication with chamber 113 via an opening in an end wall 121 of pump 110. A rod 122 having lands, heads, or enlargements 123 and 124 thereon is secured at one end to piston 112, with land or head 124 being located at the opposite end of rod 122. Housing 119 is provided with openings or ports 125, 126, and 127, and a vent port 128. The signal valve assembly 116 functions as a pair of signal valves with vent port 128 cooperating with both signal valves.

Each of intake-exhaust valve assemblies 117 and 118 include a housing 129–129' having a pair of different diameter chambers 130–130' and 131–131' therein, and in which is movably positioned a member 132–132' have heads 133–133' and 134–134' which cooperate with chambers 130–130' and 131–131'. Housing 129–129' is provided with three ports 135–135', 136–136' and 137–137', and a vent opening or port 138–138'. A source 139 of pressurized driving fluid, such as compressed air, etc., is connected to ports 135–135' via fluid lines or tube 140–140'. Port 136 of valve 117 is connected via a line or tube 141 to an opening 142 in pump end wall 121, while port 136' of valve 118 is connected to port 125 of signal valve housing 119 via a line or tube 143 which functions as a second chamber, and performs its same function as in the abovedescribed FIGS.

7–10 and FIG. 11 embodiment; namely, holding the first intake-exhaust valve 117 in the exhaust position while the second chamber 143 is pressurized. Port 137 of valve 117 is connected via a line or tube 144 to port 126 in signal valve housing 119, while port 137' of valve 118 is connected by line or tube 145 to port 127 of signal valve housing 119.

As shown in FIG. 12, the piston 112 is at the beginning of the downward stroke, as indicated by arrow 146 and is driven by pressurized driving fluid from source 139 via line 140, chamber 130 of first intake-exhaust valve 117, and line 141 into the first chamber 113. The pressurized fluid also flows into housing 119 of signal valve assembly 116 and through line 145 into chamber 131' of second intake-exhaust valve 118 forcing member 132' to the right which blocks fluid flow through line 140' into valve chamber 130' and exhausts the second chamber 143 via valve chambers 130' and 131' and port 138' in housing 129' of valve 118. As shown, chamber 131 of valve 117 is vented via port 138 and via port 137, line 144, signal valve housing 119 and vent port or hole 128. As piston 112 moves downward, the land or head 124 covers and then uncovers port 126 in signal valve housing 119, and merely serves to increase the volume of the second chamber 143, while continuing downward movement of landing or head 123 has no effect until it passes port 127 in signal valve housing 119, at which point the valves switch as described previously with respect to the other embodiments. Thus, as pointed out above, the signal valve assembly 116 comprises two signal valve sections; one comprising head 124 which cooperates with ports 126 and 128 of housing 119, and the second comprising head 123 which cooperates with ports 127 and 128, with each of the two signal valve sections being controlled by the movement of piston 112 and rod 122 connected thereto.

FIG. 12 illustrates that the second chamber 143, compared to the second chambers 32' and 61' of the embodiments of FIGS. 7–10 and 11, can be very small. While it may appear that the second chamber 143 has been eliminated, it in fact constitutes the line connected to port 136' of valve 118 and the upper end of housing 119 of signal valve 116, and it still performs its same necessary function; namely, holding the first intake-exhaust valve 117 in the exhaust position while the second chamber 143 is pressurized. Note that there is no functional significance to the pressure exerted onto the end of head 124 of signal valve 116 by the second chamber 143, and no functional significance to the changing size of the second chamber as the signal rod head 124 moves.

Upon piston 112 reaching the end of its downward stroke, head 123 of signal valve 116 passes and uncovers port 127, whereby chamber 131' of the second intake-exhaust valve 118 is vented via line 145, housing 119 and vent port 128. This allows member 132' of valve 118 to move to the left, allowing pressurized driving fluid from source 139 to pass through line 140', chamber 130', tube or second chamber 143, housing 119, tube 144 into chamber 131 of intake-exhaust valve 117, moving the member 132 to the right, thereby cutting off flow of driving fluid from source 139 into the first chamber 113, and allowing fluid in chamber 113 to exhaust via line 141, port 136, chamber 131 and vent or exhaust port 138 of valve 117. Upon exhausting of fluid from chamber 113, the spring 114 forces the piston 112 upward to complete the exhaust stroke thereof, and moves signal valve control rod upward to the position shown in FIG. 12, whereby driving fluid is again directed into chamber 113.

Figure 13:
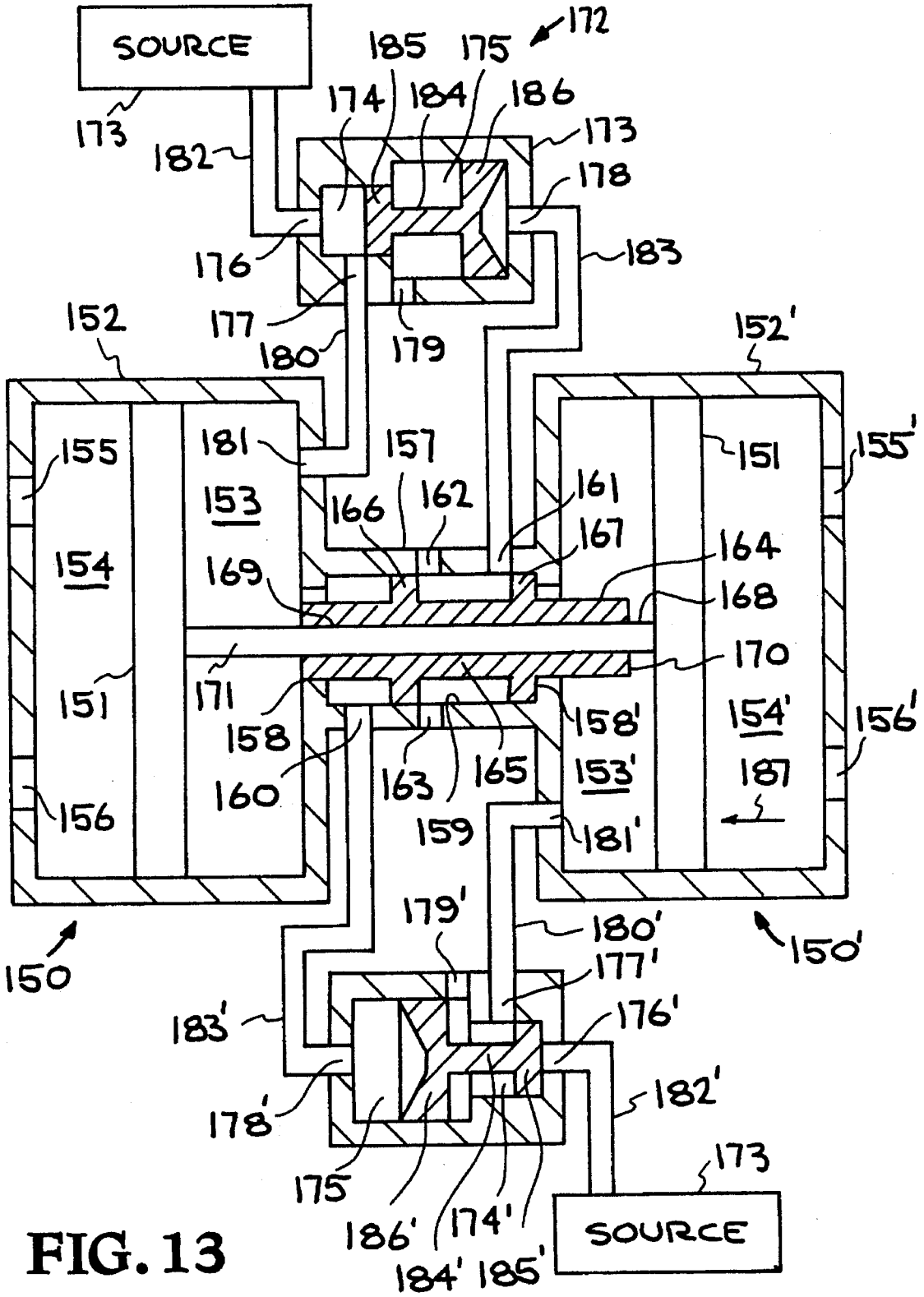
FIG. 13 illustrates another embodiment of the fluid driven pump assembly and which utilizes a sleeve valve around the connector rod to control the intake-exhaust valves.

Referring now to FIG. 13, this embodiment utilizes a sleeve arrangement to control the pressurized driving fluid, such as compressed air, in order to provide a shorter pump assembly. A pair of pump assemblies 150–150' having pistons 151–151' in housings 152–152' defining chambers therein. Pistons 151–151' divide the housing chambers into power or driving sections 153–153' and pumping sections 154–154'. Pistons 151–151' can be replaced by diaphragms. While not shown, inlet check valves and outlet check valves may be positioned in openings or ports 155–155' and 156–156' of pumps 150–150'. Pumps 150 and 150' are interconnected by a signal valve housing 157 having openings 158–158' at opposite ends, defining a chamber 159, and provided with ports or openings 160 and 161 and with a pair of vents or openings 162 and 163.

A signal valve sleeve, generally indicated at 164, is located in chamber 159 of housing 157, and comprises a signal valve member 165 having a pair of spaced lands, heads or enlarged sections 166 and 167, and a longitudinally extending central passageway 168, with end sections 169 and 170 of member 165 extending through the openings 158–158' of housing 157. A rod 171 extends through passageway 168 in signal valve 165 and is connected to pistons 151 and 151'.

A pair of intake-exhaust valve assemblies 172–172' are connected to a source 173 of pressurized driving fluid such as compressed air, and to signal valve 164, with valve assembly 172 being connected to pump 150 and valve assembly 172' being connected to pump 150'. Valve assemblies 172–172' comprise housings 173–173' having chambers 174–174' and 175–175' therein, and openings or ports 176–176', 177–177' and 178'—178' and a vent port 179–179', with ports 176–176' and 177'177' being in fluid communication with chambers 174–174' and ports 178–178' and 179–179' being in fluid communicated with chambers 175–175'. Chambers 174 and 174' of valve assemblies 172–172' are connected to power chamber sections 153 and 153' via ports 177–177', lines or tubes 180–180', and ports or openings 181–181' in pump housings 152–152'. Chambers 174 and 174' are also connected to pressurized source 173 via ports 176–176' and lines or tubes 182–182'. Chambers 175 and 175' of valve assemblies 172–172' are connected to signal valve housing 157 via ports 178–178', lines or tubes 183–183' and ports 161 and 160 of housing 157. Each of valves 172–172' includes a valve member 184–184' having heads 185–185' and 186–186'.

In operation of the FIG. 13 embodiment, movement of the pistons in the pump assemblies cause movement of the signal valve sleeve only near the end of each stroke, which controls the intake-exhaust valves similarly to the previously described embodiments. As shown in FIG. 13, pressurized fluid (gas or air) from source 173 is directed through line 182, chamber 174 of valve 172, line 180, into power section 153 of pump 150 and through opening 158, line 183' into chamber 175' of valve 172' causing valve member 184' to move to the right as shown, whereby power chamber 153' of pump 150' exhausts via line 180', chamber 174' and vent 179'. The pressurized fluid in power chamber 153 acts against end 169 of signal valve sleeve 164 causing it to be moved and held to the right as shown, whereby chamber 175 of valve 172 is vented via line 183 and vent 162 in signal valve member 157. As shown by the arrow 187, pistons 151–151' and rod 171 are moving to the left, and piston 151' is about to contact end 170 of signal valve sleeve 164, and upon contact pushes sleeve 164 to the left so as to move lands 166 and 167 to the left which cuts off pressurized fluid into line 183' and chamber 175' of valve 172', whereby pressurized fluid against head 185' of valve member 184' moves the valve member to the left, allowing pressured fluid to flow through line 180' into power chamber 153' and through line 183 into chamber 175 of valve 172, causing chamber 153 to be exhausted and piston 151' to move to the right, opposite to arrow 187. Continued movement of piston 151' to the right moves rod 171 and piston 151 to the right causing piston 151 to contact the end 169 of signal valve sleeve 164 which results in reversing the intake-exhaust valves 172–172' to the position shown in FIG. 13. Thus, the pistons 151–151' are caused to reciprocate in the housings 152–152' of pumps 150–150', which causes liquid to be pumped via pumping chambers 154–154', as described above with respect to the embodiment of FIGS. 3–6.

The embodiment of FIG. 13 provides a double piston or diaphragm system which can be made shorter overall, because the piston connecting rod is shorter. This is made possible by utilizing the sleeve around the signal rod which performs the signal valving function instead of the signal rod; the sleeve only moves during the last part of each stroke. This embodiment can be utilized in place of the FIGS. 3–6 embodiment where it is necessary to minimize the overall pump length for a given stroke distance.

Note also that the signal valve could be off-center in another shortpump embodiment, instead of being a sleeve around the connecting rod. Such an off-center signal valve could be constructed with o-ring seals in the housing, similar to the pilot valve disclosed in U.S. Pat. No. 4,854,832. The pump system of FIG. 13 can be readily modified such that one of the pistons 151–151' is free floating, as in the FIGS. 7–10 embodiment. This can be accomplished by removing one of the pistons (piston 151' for example) from rod 171 and providing that end of rod 171 with an enlarged member which will contact the end (end 170 for example) of signal valve sleeve 164 to cause Same to move as above described. Where the pistons are not connected by rod 171, a positive pressure must be provided to pumping chamber sections 154–154', as in the FIGS. 7–10 embodiment, to cause return of the pistons during the exhaust stages thereof.

It has thus been shown that the present invention provides a back-to-back fluid driven reciprocating apparatus with a pair of intake-exhaust valves and a signal valve for controlling the intake-exhaust valves based on the location of the pistons or diaphragms in the power chambers of the back-to-back pump assemblies. The valving arrangement of the present invention provides a simplified approach compared to the above-referenced prior art valve arrangements and which eliminates components and thus reduces the costs.

While particular embodiments of the invention have been illustrated and/or described to provide examples and a complete understanding of the invention, such are not intended to be limiting. Modifications and changes may become apparent to those skilled in the art, and it is intended that the invention be limited only by the scope of the appended claims.

I claim:

1. A fluid driven reciprocating apparatus, comprising:

a first intake-exhaust valve connected to a first chamber;

a second intake-exhaust valve connected to a second chamber;

a movable member located in each of Said chambers; and a means sensitive to a state of fluid displacement in said first chamber for actuating said first and second intake-exhaust valves said means for actuating said first and second intake-exhaust valves including a single signal valve assembly operatively connected to at least one of said movable members to activate said first and second intake-exhaust valves, said means interconnecting said movable members in a back-to-back relation.

2. The apparatus of claim 1, wherein said member is moved by said movable member only at a point near an end of movement of said movable member.

3. The apparatus of claim 1, wherein said first and second chambers define at least power chambers in a pair of pump assemblies.

4. The apparatus of claim 3, wherein said movable members are selected from the group consisting of pistons and diaphragms.

5. The apparatus of claim 3, wherein each of said pair of intake-exhaust valves comprises:

a housing;

said housing having a plurality of different diameter chambers therein and a plurality of openings extending through said housing and in communication with said plurality of chambers; and a movable valve member positioned in said housing;

said movable valve member including a plurality of heads of different diameters, and adapted to cooperate with said different diameter chambers and said plurality of openings to allow fluid to pass into and out of said housing.

6. The apparatus of claim 3, wherein said means includes:

a hollow member having a plurality of openings therein; and a rod extending through said hollow member and connected to at least one of said movable members;

said rod including spaced apart enlarged sections, which upon movement of the movable member cooperates with said openings in said hollow member to allow passage of fluid through certain of said openings.

7. The apparatus of claim 3, wherein each of said pump assemblies additionally includes a pumping chamber therein, and intake and exhaust valves operatively connected with each of said pumping chambers.

8. The apparatus of claim 3, wherein said pair of intake-exhaust valves are operative connected to a source of fluid pressure for moving said movable members in said power chambers.

9. A fluid driven reciprocating apparatus, comprising;

a first intake-exhaust valve connected to a first chamber;

a second intake-exhaust connect to a second chamber; and means sensitive to a state of fluid displacement in said first chamber for actuating said first and second intake-exhaust valves, said means for actuating said first and second intake-exhaust valves including a signal valve assembly, said signal valve assembly being mounted to only one of said first and second chambers, and including a pair of float activated valves.

10. A valve arrangement for a pair of reciprocating pumps having movable members mounted in a back-to-back arrangement, said valving arrangement comprising:

a pair of intake-exhaust valves, each connected directly to a respective reciprocating pump; and a single signal valve for activating said pair of intake-exhaust valves, said signal valve including a rod connected to only one of said movable members of said reciprocating pumps.

11. The valve arrangement of claim 10, wherein each of said pair of intake-exhaust valves comprises:

a housing;

said housing containing a pair of different diameter chambers therein;

said housing also being provided with four openings, two of said opening being in communication with a smaller of said pair of different diameter chambers, and two of said openings being in communication with a larger of said pair of different diameter chambers; and a movable member positioned in said different diameter chambers;

said movable member including a pair of head sections of different diameter, one of said head sections being constructed to cooperate with said smaller diameter chamber, and another of said head sections being constructed to cooperate with said larger diameter chamber;

whereby movement of said movable member causes covering and opening of certain of said four openings in said housing.

12. The valve arrangement of claim 11, wherein one of said four openings in said housing is adapted to be connected to a source of pressurized fluid, wherein two of said four openings are adapted to be connected to a power chamber of each of pump assembly, and one of said four openings being connected to exhaust.

13. The valve arrangement of claim 10, wherein said signal valve comprises:

a hollow member connected to each of said pump assemblies;

said hollow member having a plurality of openings therein; and a rod extending through said hollow member and connected to one of said movable members of said pump assemblies;

said rod being provided with a plurality of spaced heads;

whereby movement of a movable member of said pump assemblies moves said rod whereby said heads thereon fluid may pass through certain of said openings in said hollow member to activate said pair of intake-exhaust valves.

14. The valve arrangement of claim 13, wherein said plurality of openings in said hollow member are located such that two openings are axially spaced apart, and at least one additional opening is located intermediate said spaced apart openings.

15. In a back-to-back fluid driven pump assembly having movable members defining back-to-back power chambers therein, the improvement comprising:

a pair of intake-exhaust valves;

each of said intake-exhaust valves being directly connected to one of said power chambers, and adapted to be connected to a source of fluid pressure; and a signal valve including a rod connected to only one of said movable members;

said signal valve being operatively connected by fluid communication to each of said pair of intake-exhaust valves for activating same upon movement of said rod by a movable member;

whereby said power chambers may be selectively connected to an associated source of fluid pressure for driving a movable member positioned in said power chamber when connected to an associated source of fluid pressure.

16. The improvement of claim 15, wherein each of said intake-exhaust valves comprises, a housing having a pair of chambers therein and a plurality of ports in communication with said chambers, and a valve member having a pair of heads thereon which cooperate with said pair of chambers to selectively open and close certain of said ports, said valve member being adapted to be moved by fluid pressure directed thereto by said signal valve.

17. A fluid pumping apparatus, comprising:

a single cylinder;

means for allowing liquid to be pumped to enter and discharge from said cylinder;

means for allowing a pressurized driving fluid to enter and exhaust from said cylinder;

a pair of intake/exhaust valve assemblies operatively connected to said means for allowing a pressurized driving fluid to enter and exhaust from said cylinder;

one of said intake/exhaust valve assemblies being adapted for connection to an associated source of said pressurized driving fluid; and a sign a single signal valve means for controlling said pair of intake/exhaust valve assemblies in response to a preselected amount of pressurized driving fluid in said cylinder;

whereby said pressurized driving fluid as it enters said cylinder causes liquid in said cylinder to increase in pressure and be discharged from said cylinder, and whereby said single signal valve means upon the preselected amount of pressurized driving fluid entering said cylinder activates said pair of intake/exhaust valve assemblies to cause said pressurized driving fluid to exhaust from said cylinder and allow liquid to be pumped to enter said cylinder.

18. The liquid pumping apparatus of claim 17, additionally including means for exhausting said pressurized driving fluid from said cylinder.

19. The liquid pumping apparatus of claim 18, wherein said means for exhausting said pressurized driving fluid from said cylinder includes a spring connected to a movable member located in said cylinder.

20. The liquid pumping apparatus of claim 18, wherein said means for exhausting said pressurized driving fluid from said cylinder includes a source of low pressure liquid to be pumped and valve means for allowing the low pressure liquid to enter said cylinder.

21. The liquid pumping apparatus of claim 17, additionally including a movable member located in said cylinder and intermediate the liquid to be pumped and the pressurized driving fluid.

22. The liquid pumping apparatus of claim 21, wherein said signal valve means is mounted so as to be moved by said movable member.

23. The liquid pumping apparatus of claim 22, wherein said signal valve means includes a movable sleeve.

24. The liquid pumping apparatus of claim 22, wherein said signal valve means includes a rod operatively connected to said movable member.

25. The liquid pumping apparatus of claim 24, wherein said rod is provided with a pair of spaced heads adapted to cover and uncover ports in a housing in which said pair of spaced heads are located.

26. The liquid pumping apparatus of claim 17, additionally including a second cylinder operatively connected to said cylinder via one of said pair of intake/exhaust valves.

27. The liquid pumping apparatus of claim 26, wherein said single signal valve means comprises a housing having opposite open ends and a plurality of ports, said open ends of said housing being in open communication with each of said cylinders, and a signal valve sleeve movable mounted in said housing and adapted to cover and uncover certain of said ports in said housing upon movement thereof caused by the amount of pressurized driving fluid in said cylinders, each of said pair of intake/exhaust valves being operatively connected to certain of said ports in said housing.

28. The liquid pumping apparatus of claim 27, wherein at least one of said cylinders includes a movable member, and wherein said signal valve sleeve is moved in said housing by contact with said movable member.

29. The liquid pumping apparatus of claim 28, wherein said signal valve sleeve includes a passageway extending there through, and a rod positioned in said passageway and connected to said movable member in said at least one cylinder.

30. The liquid pumping apparatus of claim 29, wherein each of said cylinders include a movable member therein, and wherein said rod is connected to each of said movable members.

31. The liquid pumping apparatus of claim 30, wherein each of said intake/exhaust valve assemblies include a housing defining a pair of chambers therein, said housing include a plurality of ports in communication with said pair of chambers, and a movable member having a pair of heads located in said chambers, a first of said chambers being adapted to be connected to one of said cylinders and to a source of pressurized driving fluid, a second of said chambers being adapted to be connected to one of said ports in said housing of said signal valve means and to vent.

32. A fluid pumping apparatus, comprising:

at least one cylinder;

means for allowing liquid to be pumped to enter and discharge from said cylinder;

means for allowing a pressurized driving fluid to enter and exhaust from said cylinder;

a pair of intake/exhaust valve assemblies operatively connected to said means for allowing a pressurized driving fluid to enter and exhaust from said cylinder;

one of said intake/exhaust valve assemblies being adapted for connection to an associated source of said pressurized driving fluid; and signal valve means for controlling said pair of intake/exhaust valve assemblies in response to a preselected amount of pressurized driving fluid in said cylinder;

whereby said pressurized driving fluid as it enter said cylinder causes liquid in said cylinder to increase in pressure and be discharged from said cylinder, and whereby said signal valve means upon the preselected amount of pressurized driving fluid entering said cylinder activates said pair of intake/exhaust valve assemblies to cause said pressurized driving fluid to exhaust from said cylinder and allow liquid to be pumped to enter said cylinder;

said signal valve means including a plurality of float activated members, one of said float activated member being located so as to be activated by said liquid to be pumped, and another of said float activated members being located so as to be activated by said pressured driving fluid.

33. An apparatus for alternately pressurizing and exhausting a pair of chambers comprising:

a first intake-exhaust valve connected to a first chamber, said first intake-exhaust valve having a first control port, said first chamber receiving pressurized driving fluid when said first control port is vented, and said first chamber being exhausted when said first control port is pressurized;

a second intake-exhaust valve connected to a second chamber, said second intake-exhaust valve having a second control port, said second chamber receiving pressurized driving fluid when said second control port is vented, and said second chamber being exhausted when said second control port is pressurized;

first float activated signal valve means for venting said first control port when said second chamber is exhausted, additionally venting said first control port when said first chamber is substantially empty of driving fluid, and otherwise pressurizing said first control port when said second chamber is pressurized; and second float activated signal valve means for venting said second control port when said first chamber is exhausted, additionally venting said second control port when said first chamber is substantially full of driving fluid, and otherwise pressurizing said second control port when said first chamber is pressurized.

* * * * *